United States Patent [19]

McHugh

[11] Patent Number: 4,497,508

[45] **Date of Patent: * Feb. 5, 1985**

[54] PROTECTIVE BOOK COVER

[76] Inventor: Edward L. McHugh, 7437 Royal Dominion Dr., Bethesda, Md. 20817

[ * ] Notice: The portion of the term of this patent subsequent to Oct. 26, 1999 has been disclaimed.

[21] Appl. No.: 392,372

[22] Filed: Jun. 28, 1982

Related U.S. Application Data

[63] Continuation-in-part of Ser. No. 179,435, Aug. 19, 1980, Pat. No. 4,355,822.

[51] Int. Cl.[3] ..... B42D 3/10; B42D 3/06; B42D 3/00

[52] U.S. Cl. ..... 281/34; 281/35; 281/36; 281/29

[58] Field of Search ..... 281/29, 31, 34, 35, 281/36

[56] References Cited

U.S. PATENT DOCUMENTS

| | | | |
|---|---|---|---|
| 2,808,274 | 10/1957 | Goldman | 281/34 |
| 3,572,767 | 3/1971 | Learned et al. | 281/34 |
| 3,915,778 | 10/1975 | Carter et al. | 281/34 |
| 4,259,799 | 4/1981 | Fulton | 281/34 |
| 4,355,822 | 10/1982 | McHugh | 281/34 |

*Primary Examiner*—Paul A. Bell
*Assistant Examiner*—Paul M. Heyrana, Sr.
*Attorney, Agent, or Firm*—Connolly and Hutz

[57] ABSTRACT

A protective book cover includes a pair of pocket sections for removably receiving the front and back covers of a book with the open ends of the pocket sections disposed toward each other. The pocket sections fit snugly on the book cover juxtaposed the book binding. The flap on one section is inserted into the other section while the flap on the other section secures both sections together.

7 Claims, 9 Drawing Figures

10
12
14
16
18
20
22
24
26
28
30
32
34
36
38
40
42
44
46
48
A
B

PROTECTIVE BOOK COVER

CROSS-REFERENCE TO RELATED APPLICATION

This application is a continuation-in-part of co-pending application Ser. No. 179,435 filed Aug. 19, 1980 now U.S. Pat. No. 4,355,822.

BACKGROUND OF INVENTION

Paperback books in current use are generally of two types. One type is works of fiction and non-fiction which are read over a period of time for reading enjoyment. The other type is more of a reference variety such as textbooks or directories which are periodically referred to over substantially long periods of time and may be frequently used. It is desirable to provide a removable book cover for such paperback books particularly to protect the book while in use or while being stored. Book covers are also desirable under certain circumstances when the reader does not want others to be aware of his specific material. Prior art attempts for providing suitable removable book covers have not been totally satisfactory. One major problem is that while reading, the cover tends to slip off the book. Usually the reader must use two hands for holding the book open for reading. Similar objections are found for book covers used in other types of books such as textbooks, telephone directories, etc.

U.S. Pat. Nos. 4,209,187 and 2,901,103 represent exemplary prior art book covers.

SUMMARY OF INVENTION

An object of this invention is to provide a removable protective book cover which will be used on paperback books, textbooks, directories and the like including hardback books.

A further object of this invention is to provide a book cover which remains securely on the book even during use and yet which may be conveniently removed therefrom so as to be useable on a different book.

A still further object of this invention is to provide a book cover which may be conveniently manufactured at relatively small cost.

A yet further object of this invention is to provide a book cover which is effective on books of various thicknesses.

In accordance with this invention, a removable protective book cover includes a pair of pocket sections telescopically receiving the front and back covers of a book. The outer members of each pocket section are connected to each other by a spline. The open sides of the pocket sections are disposed toward each other spaced apart by a distance less than the width of each pocket section. In this manner the pocket sections may be located generally adjacent to the inner edges of the front and back covers.

In a preferred embodiment of this invention the pocket sections are separate members and the spline is a flap integrally extending from the outer member of one pocket section. The book cover may accommodate different book thicknesses in accordance with the location the other pocket section is connected to the flap. Such connection is preferably by means of a reuseable adhesive.

Various ramifications are possible in practicing the invention such as providing a bookmark strip integral with one of the pocket sections. The front pocket section may be opaque while the back pocket section may be transparent, translucent or opaque.

THE DRAWINGS

DETAILED DESCRIPTION

Figures 1, 2, 3, 4, 5:
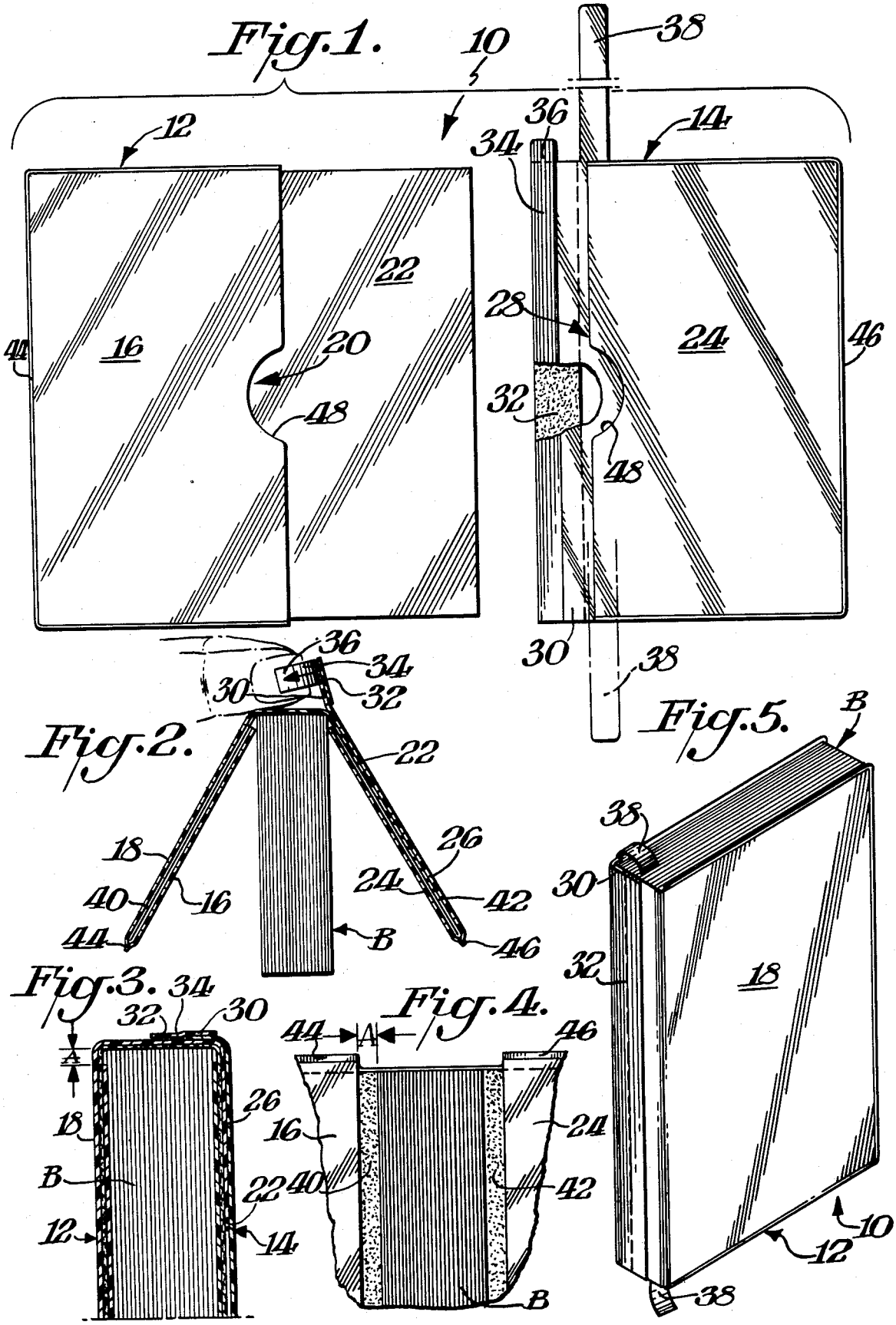
FIG. 1 is a plan view of a book cover in accordance with this invention before the individual members are secured together.
FIG. 2 is a cross-sectional view in elevation showing the book cover of FIG. 1 while being mounted on a book.
FIG. 3 is a cross-sectional view in elevation showing the book cover of FIGS. 1–2 mounted on a book.
FIG. 4 is a fragmental plan view of the book cover of FIGS. 1–3 mounted on a book.
FIG. 5 is a perspective view of the book cover of FIGS. 1–4.

FIG. 1 shows a book cover 10 in accordance with this invention. As indicated therein, the book cover 10 includes a pair of pocket sections 12, 14 adapted to telescopically receive the front and back covers of a book. It is to be understood that the thickness of the various elements in cover 10 has been exaggerated in the drawings for a better understanding of the invention. Pocket section 12 which may be, for example, receiving the front book cover includes an inner member 16 and an outer member 18 (FIGS. 2–3) which are secured together along three of their edges in any suitable fashion leaving the fourth side or edge 20 open so as to form the pocket. Outer member 18 has a flap 22 integrally extending therefrom.

Pocket section 14 similarly has an inner member 24 and an outer member 26 secured thereto along three sides thereof with the fourth side or edge 28 likewise open to form the pocket section. A narrow flap 30 also extends from pocket section 14. An adhesive strip 32 is secured to the outer portion of flap 30 but extends outwardly beyond flap 30 so that its adhesive inner surface may be exposed. The exposed portion of the adhesive inner surface of strip 32 is covered by a removable sheet 34 which extends beyond the periphery of pocket section 14 so as to provide a convenient pull tab 36 for purposes later described. Pocket section 14 also includes an integral extension 38 extending outwardly from outer member 26.

FIGS. 2–5 illustrate cover 10 removably secured on a book B. To mount the cover on a book, front cover 40 of book B may be telescoped into first section 12 with the flap 22 freely extending therefrom. As best shown in FIGS. 2 and 4, front section 12 is dimensioned so as to extend substantially adjacent to the binding of book B or inner edge of cover 40. Back cover 42 may then be inserted into section 14. Obviously the sequence of inserting the front and back covers is not critical.

Flap 22 is preferably of a length slightly smaller than the length of each pocket section. Accordingly after each pocket section is mounted on a respective book cover, flap 30 may be bent away from the book binding, and flap 22 may be slid into pocket section 14 between back cover 42 and outer member 26. Alternatively, after pocket section 12 is mounted on front cover 40, flap 22 may be pressed against the outer side of back cover 42, and flap 22 and back cover 42 may, as a unit, be telescoped into pocket section 14.

FIG. 2 illustrates the position of the various components of cover 10 immediately before they are secured together. In this respect, the inner member of each pocket section is located adjacent to the binding of book B. The portion of flap 22 which is exposed from pocket 14 covers the binding and thus acts as a spline. Flap 30 is bent outwardly away from the spline, and in this condition, protective sheet 34 is peeled from adhesive strip 32 by grasping tab 36 and pulling outwardly to expose the adhesive on strip 32 which extends beyond flap 30. The exposed portion of strip 32 is then pressed against flap 22 for securing the pocket sections 12 and 14 together.

During use of the book, extension 38 may function as a bookmark by being bent downward and extends completely down and beyond the book length (FIG. 5). Other ramifications of this invention are also possible. For example, means may be provided such as loops or the like to which pens, pencils or other instruments may be removably secured particularly when book cover 10 is used as a protective cover for a reference book. Decorations or advertisements may also be applied to book cover 10.

An important feature of this invention is that the spacing between the open edges 20 and 28 of the pocket sections 12 and 14 when the pocket sections are secured together is less than the width of each of the inner members 16, 24. This assures that the inner members 16, 24 will be disposed close to the binding of the book B. Accordingly when the book is opened during use, the pocket sections will remain in place on their respective covers and not tend to slip off which is a fault characteristic of the prior art. Additionally the pocket sections tend to hold the book covers in an open or spread position so that a reader can hold the book in only one hand while reading.

Book cover 10 may be made of various materials and preferably a heat sealable material such as vinyl is used so that the edges connecting the three closed sides of each pocket section may be conveniently secured together. During manufacture, however, the outer edge 44 of pocket section 12 and the outer edge 46 of pocket section 14 may be formed by having inner members 16, 24 extending from their respective outer members and then folding the inner members to thereby create their respective edges 44, 46. The pocket sections 12, 14 may likewise be transparent, translucent or opaque and may be of different colors or tints. It is also possible to practice this invention by having the pocket sections of differing colors, tints or degrees of transparency. There are occasions, for example, where a user may wish to keep private from onlookers the type of book the user is reading. In such case an opaque pocket section particularly for the front cover would be preferable.

As previously indicated in the preferred practice of this invention, the inner member 16, 24 of each pocket section is located adjacent the binding of the book. There should, however, be a slight gap from the binding to avoid the inner member digging in and damaging the binding. FIGS. 3 and 4 illustrate this gap A.

Figure 6:
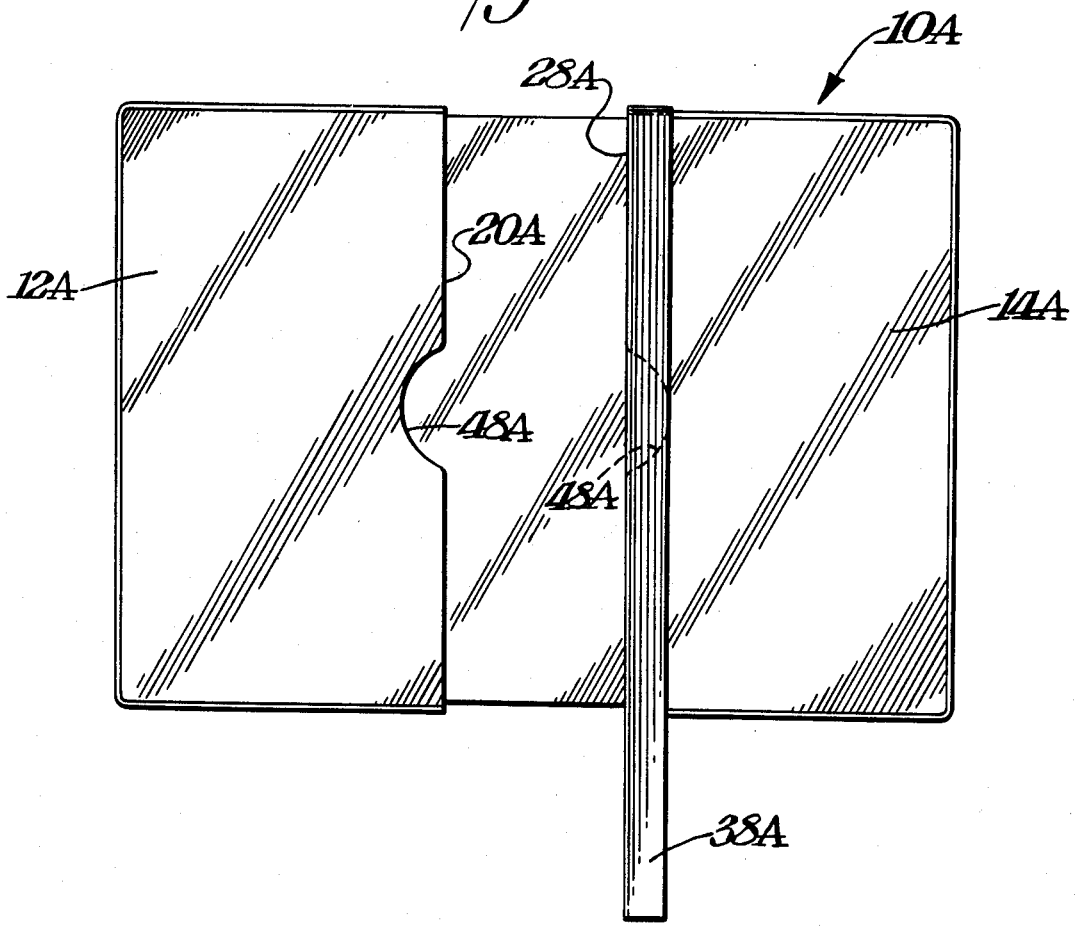
FIG. 6 is a plan view of a modified form of book cover.

FIG. 6 is a plan view of an alternative form of this invention wherein the cover 10A includes its pocket sections 12A and 14A integrally attached. This embodiment has the advantage of simplicity in manufacture but loses the advantage of adaptability of customizing for various book thicknesses. In FIG. 6, like reference numerals are used for like parts, thus a bookmark 38A is provided adjacent the inner edge 28A of back pocket section 14A. Each front edge 20A, 28A includes a cut out 48A which is useful in facilitating the insertion of the book cover into the respective pocket section. The embodiment of FIGS. 1–5 may likewise include cut outs 48, although in that embodiment, such cut outs are not as necessary.

The illustrated embodiments are particularly designed for conventional paperback books which are generally $4\frac{1}{4}$ inches by 7 inches. In the embodiment of FIG. 6, the gap or spacing of the spline section would be about 2 inches. With the embodiment of FIGS. 1–5, however, the spline would, of course, correspond to the thickness of the book. Gap A is preferably 1/16 inch $\pm$1/32 inch. The long edge of each pocket section is preferably $7\frac{1}{8}$ to $7\frac{1}{4}$ inches while the overall width (FIG. 6) of the book cover is $10\frac{1}{4}$ inches with each pocket section being 4 to 4 1/16 inches thus leaving a gap or spline of $2\frac{1}{8}$ to $2\frac{1}{4}$ inches. Bookmark 38, 38A is $\frac{1}{2}$ inch wide and $9\frac{3}{4}$ to 10 inches long which also represents a departure from the prior art where such bookmarkers are generally 9 inches or less. These dimensions would be effective on all such standard sized paperback books of substantially all thicknesses. The invention is not limited to use of paperback books. Thus by appropriate dimensioning, the invention may also be practiced with hardback books, telephone directories and the like.

As previously indicated, any suitable materials may be used for the components of the book cover. Similarly any suitable adhesive for strip 32 may be used. In the preferred practice of the invention, however, a conventional reuseable adhesive is used so that the same book cover may be reused for various books, and where the books have different thicknesses, adhesive strip 32 may be secured to different locations on flap 22.

Figure 7:
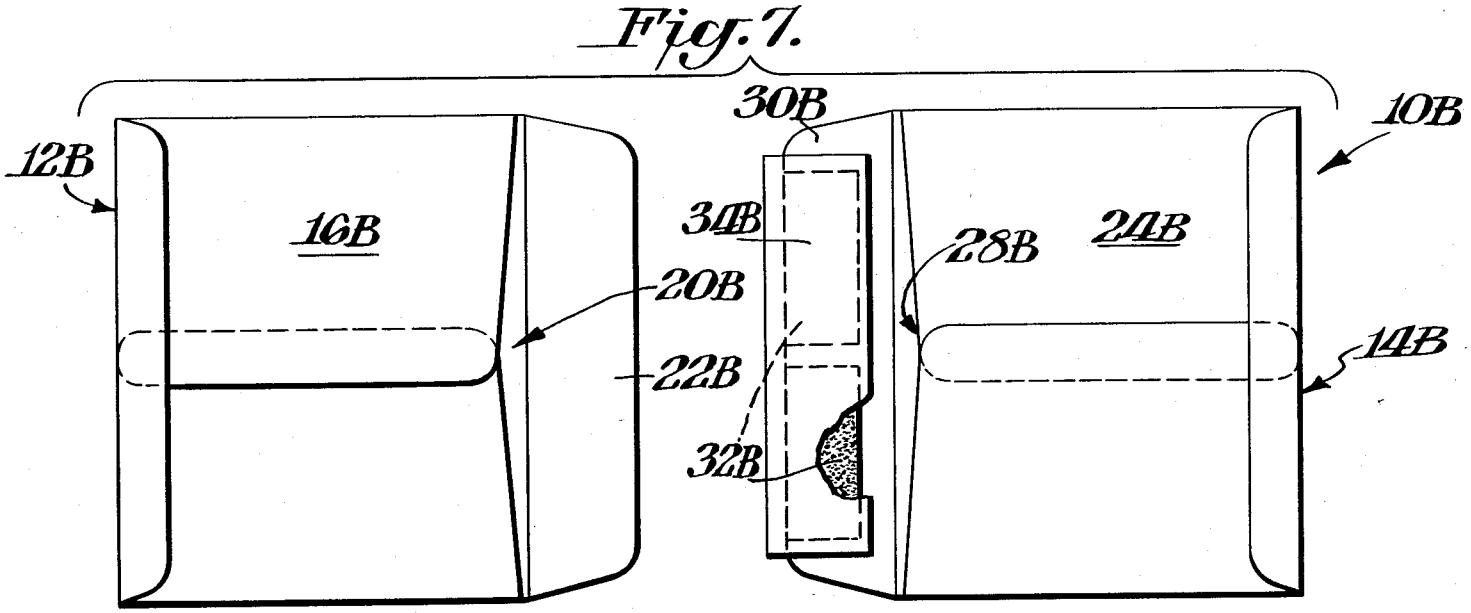
FIG. 7 is a plan view similar to FIG. 1 of a further form of book cover in accordance with this invention.
Figure 9:
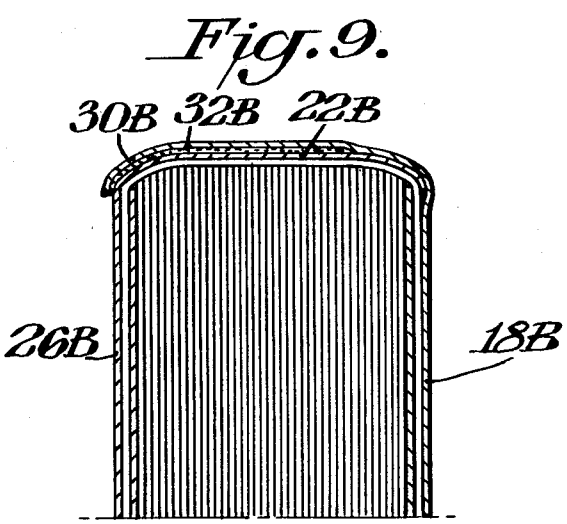
FIG. 9 is a cross-sectional view showing the book cover of FIGS. 7–8 mounted on a book.
Figure 8:
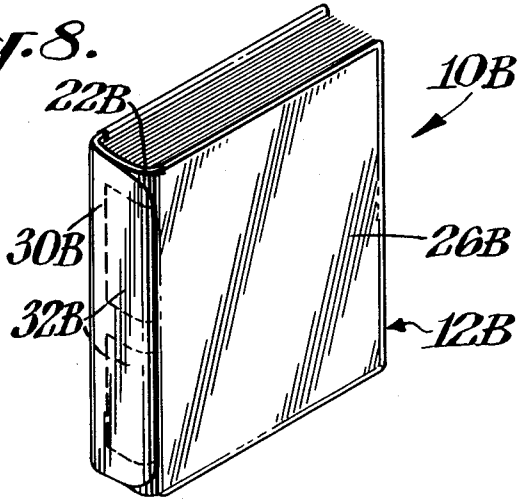
FIG. 8 is a perspective view of the book cover of FIG. 7 mounted on a book.

FIGS. 7–9 show an alternative form of book cover 10B. In this figures like reference numbers are used for like parts with the suffix B being added. In this embodiment the pocket sections are made similar to mailing envelopes. As with such envelopes the flaps 22B and 30B have a pronounced taper which particularly facilitates flap 22B being tucked into pocket section 14B in a completely flat condition without any bulging. Both flaps may have adhesive or as illustrated only flap 30B is provided with adhesive 32B. Adhesive 32B may be of any suitable type. A reusable adhesive, however, is preferred as is known in the stationary art.

The use of envelope technology is particularly advantageous since it is a well developed art which lends itself to economical mass production techniques and can result in a product which is of such high strength as to be virtually indestructible. A suitable material would be DuPont's TYVEK, a spunbonded olefin. The fibrous envelope type material also lends itself to printing from camera-ready copy on any of the pocket section members. This feature would be particularly desirable to permit advertising or other information to be placed on the cover 10B. When used for school textbooks, for example, such information as school year calendars, conversion charts, historical data, PTA information, etc. could be provided as a student aid.

As shown in FIG. 7, each pocket section 12B, 14B is made into envelope form by folding a sheet along three edges with the folded portions being secured together to form the inner members 16B, 24B, as conventionally done in envelope manufacturing.

As shown in the drawings, particularly FIGS. 1 and 7, the inner and outer members of each pocket section may be considered as having coterminous upper and lower edges which are parallel to each other and which are joined by coterminous remote edges perpendicular to the upper and lower edges with these coterminous edges joined together and each pocket section being completely open along its side opposite the remote edge. Similarly each flap may be considered as having an upper edge and a lower edge disposed in generally the same direction as the upper and lower edges of its pocket section. As shown in FIG. 1, the distance between the upper edge and lower edge of flap 22 is less than the distance between the corresponding upper and lower edges of the opposite pocket section 14 so that flap 22 can be inserted in a completely flat condition into pocket section 14 as illustrated, for example, in FIG. 2. With respect to the embodiment of FIG. 7, the flaps 22B and 30B are of a size and shape which are mirror images of each other with the upper and lower edges of each flap tapering toward each other so that the distance between the upper and lower edge of each flap would be less than the distance between the upper and lower edge of each pocket section.

The protective book cover of this invention thus provides a removable cover which may accommodate books of varying thicknesses while still maintaining an effective cover which will not tend to slip off the book and will facilitate the user reading the book.

What is claimed is:

1. A removable book cover comprising a first pocket section and a second pocket section for receiving a respective cover of a book, each of said pocket sections being of envelope-type form having an inner member and an outer member, said inner member and said outer member having coterminous upper edges and coterminous lower edges parallel to said upper edges and having coterminous remote edges perpendicular to said upper edges and said lower edges, said inner and outer members being connected together along said coterminous upper and lower and remote edges, each of said pocket sections being completely open along its side opposite said remote edge, said outer member of each of said pocket sections extending outwardly beyond its open side whereby one of said pocket sections may be telescoped over the front cover of a book and the other of said pocket sections may be telescoped over the back cover of the book with said flaps extending toward each other, each of said flaps having an upper edge and a lower edge disposed in generally the same direction as said respective upper edge and said lower edge of its pocket section, said upper edge and lower edge of each of said flaps being tapered toward each other, the distance between said upper edge and said lower edge of each of said flaps being less than the distance between said upper edge and said lower edge of its pocket section whereby after said pocket sections have been telescoped over the front and back covers of the book said flap of said first pocket section may be inserted in a completely flat condition against the cover of the book, and adjustable attaching means on said flap of said second pocket section whereby after said first flap is tucked into said second pocket section said first and said second pocket sections may be secured together by said attaching means to thereby retain said pocket sections on their respective covers of the book.

2. The cover of claim 1 wherein each of said pocket sections is made of a spunbonded olefin material.

3. The cover of claim 1 wherein the flaps are of a size and shape which are mirror images of each other.

4. The cover of claim 1 wherein the distance between said inner members when said pocket sections are secured together is less than the distance between said remote edge and the edge of said inner member opposite its said remote edge for each of said pocket sections.

5. The cover of claim 1 wherein attaching means comprises adhesive means on said flap of second pocket section, and said flap of said first pocket section being free of adhesive material.

6. The cover of claim 1 wherein each pocket section is of one piece construction formed by folding portions of a single sheet along three edges which correspond to said upper edge and said lower edge and said remote edge with said folded portions being secured together.

7. The cover of claim 1 in combination therewith, a book having a front cover and a back cover secured together by a binding, one of said pocket sections being telescoped over said front cover, the other of said pocket sections being telescoped over said back cover, said inner members of said pocket sections being located near said binding, said flap of said first pocket section being tucked into said second pocket section against its respective book cover with said flap of said first pocket section being in a completely flat condition, and said pocket sections being secured together by said attaching means.

* * * * *